US008602319B2

(12) United States Patent
De Payva

(10) Patent No.: US 8,602,319 B2
(45) Date of Patent: Dec. 10, 2013

(54) NEEDLE VALVE MEMBER WITH FRUSTOCONICAL GUIDE SEGMENT AND FUEL INJECTOR USING SAME

(75) Inventor: Jeffrey De Payva, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 566 days.

(21) Appl. No.: 12/899,931

(22) Filed: Oct. 7, 2010

(65) Prior Publication Data

US 2012/0085835 A1 Apr. 12, 2012

(51) Int. Cl.

| | |
|---|---|
| ***F02D 1/06*** | (2006.01) |
| ***F02M 59/00*** | (2006.01) |
| ***F02M 39/00*** | (2006.01) |
| ***F02M 51/00*** | (2006.01) |
| ***B05B 1/30*** | (2006.01) |

(52) U.S. Cl.
USPC ..... 239/5; 239/533.2; 239/533.3; 239/533.9; 239/584; 239/585.4; 239/585.5

(58) Field of Classification Search
USPC ..... 239/5, 533.2, 533.3, 533.8, 533.9, 239/533.12, 584, 585.4, 585.5
See application file for complete search history.

(56) References Cited

U.S. PATENT DOCUMENTS

| | | | | |
|---|---|---|---|---|
| 4,260,112 | A * | 4/1981 | Grgurich | 239/533.8 |
| 4,540,126 | A | 9/1985 | Yoneda et al. | |
| 5,465,907 | A * | 11/1995 | Hofmann | 239/533.9 |
| 5,546,908 | A | 8/1996 | Stokes | |
| 5,551,391 | A | 9/1996 | Beck et al. | |
| 5,979,803 | A | 11/1999 | Peters et al. | |
| 6,076,508 | A | 6/2000 | Nakano | |
| 6,302,080 | B1 | 10/2001 | Kato et al. | |
| 6,338,445 | B1 * | 1/2002 | Lambert et al. | 239/533.12 |
| 6,705,551 | B1 * | 3/2004 | Kienzler et al. | 239/533.3 |
| 7,100,847 | B2 | 9/2006 | Christ et al. | |
| 7,143,964 | B2 | 12/2006 | Kuegler | |
| 7,249,591 | B2 | 7/2007 | Shibata | |
| 7,367,517 | B2 * | 5/2008 | Tojo et al. | 239/584 |
| 7,690,588 | B2 | 4/2010 | Gibson et al. | |
| 2007/0272771 | A1 * | 11/2007 | Nozaki et al. | 239/533.12 |
| 2008/0105767 | A1 | 5/2008 | Fujii et al. | |
| 2009/0032622 | A1 * | 2/2009 | Gibson et al. | 239/533.9 |

* cited by examiner

*Primary Examiner* — Ryan Reis
(74) *Attorney, Agent, or Firm* — Liell & McNeil

(57) ABSTRACT

A fuel injector includes an injector body with a tip component that defines at least one nozzle outlet. A needle valve member is positioned in the injector body and includes a frustoconical segment positioned in a frustoconical bore to separate a needle control chamber from a nozzle chamber. The needle valve member includes an opening hydraulic surface exposed to fluid pressure in the nozzle chamber, and a closing hydraulic surface exposed to fluid pressure in the needle control chamber. The frustoconical bore and the frustoconical segment have a narrowing taper in the direction of an injector tip. The frustoconical features tend to slow the initial opening of the nozzle outlets, and hasten their closure relative to a counterpart injector with cylindrical needle guide features.

17 Claims, 2 Drawing Sheets

NEEDLE VALVE MEMBER WITH FRUSTOCONICAL GUIDE SEGMENT AND FUEL INJECTOR USING SAME

TECHNICAL FIELD

The present disclosure relates generally to fuel injectors, and more particularly to a needle valve member for a fuel injector that includes a frustoconical guide segment.

BACKGROUND

Almost all fuel injectors include an injector body that defines one or more nozzle outlets, and includes a needle valve member that moves between positions to open and close the nozzle outlets. The needle valve member is typically guided within the fuel injector via a relatively tight diametrical clearance between a cylindrical guide segment of the needle valve member and a cylindrical guide bore disposed within the fuel injector body. The needle valve member includes an opening hydraulic surface that is exposed to fluid pressure in a nozzle chamber, and a spring is utilized to bias the needle valve member downward toward a closed position. In some fuel injectors, the needle valve member includes a closing hydraulic surface exposed to fluid pressure in a needle control chamber. In these instances, an electronically controlled valve is moved to fluidly connect and disconnect the needle control chamber from a low pressure passage in order to change pressures on the closing hydraulic surface of the needle valve member to facilitate movement of the needle valve member for injection events. These fuel injectors can be considered to include a direct operated check.

Over the years, engineers have continued to seek ways to inject fuel into the combustion space of a compression ignition engine in a manner that reduces the production of undesirable emissions, including but not limited to, NOx, particulate matter and unburned hydrocarbons. In general, these goals are improved by operating the fuel injector in a way that the needle valve member lifts toward an open position at a slower rate than it is moved toward a closed position. Thus, abrupt closure of the nozzle outlets is generally preferred, and a less than abrupt opening of the nozzle outlets has found favor. In this regard, many efforts have been made to improve this aspect of control including changes and refinements to electrical actuators, their associated valves, adding orifices to alter pressure change rates, changing area ratios of hydraulic features and many more considerations in a continuing effort to eek out incremental improvements in performance. Nevertheless, easily implemented improvements remain problematic and elusive.

The present disclosure is directed to one or more of the problems set forth above.

SUMMARY OF THE DISCLOSURE

In one aspect, a fuel injector includes an injector body with a tip component that defines at least one nozzle outlet, and has disposed therein a needle control chamber separated from a nozzle chamber by a frustoconical bore that tapers inward in a direction of the tip component. A needle valve member is positioned in the injector body, and includes an opening hydraulic surface exposed to fluid pressure in the nozzle chamber, and a closing hydraulic surface exposed to fluid pressure in the needle control chamber. The needle valve member is movable between a first position at which the nozzle outlet is blocked from the nozzle chamber, and a second position at which the nozzle outlet is open to the nozzle chamber. A frustoconical segment of the needle valve member is positioned in the frustoconical bore and has a narrowing taper in the direction of the tip component.

An injection event is initiated by the fuel injector by moving the needle valve member from a closed position toward an open position by reducing pressure on the closing hydraulic surface. An end of an injection event is initiated by moving the needle valve member from the open position toward the closed position by increasing pressure on the closing hydraulic surface.

In another aspect, a needle valve member for a fuel injector includes a frustoconical segment positioned between a closing hydraulic surface and a tip. The frustoconical segment narrows in a direction of the tip. An enlarged spring support shoulder is positioned between the tip and the frustoconical segment. An annular valve surface is positioned between the tip and the enlarged spring support shoulder. An opening hydraulic surface is positioned between the annular valve surface and the frustoconical segment.

DETAILED DESCRIPTION

Figure 1:
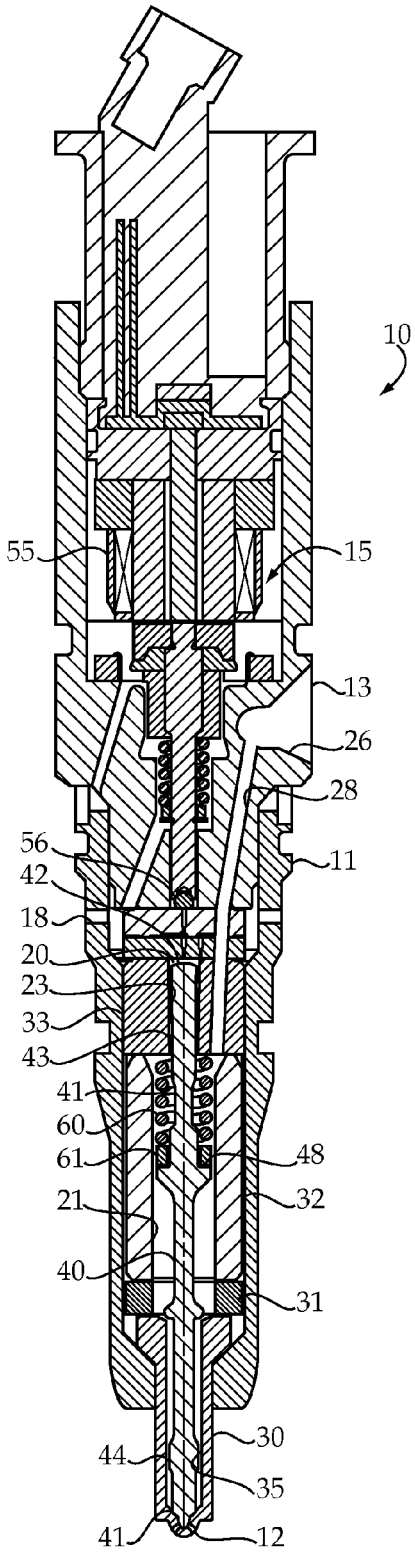
FIG. 1 is a front sectioned diagrammatic view of a fuel injector according to the present disclosure.
Figure 2:
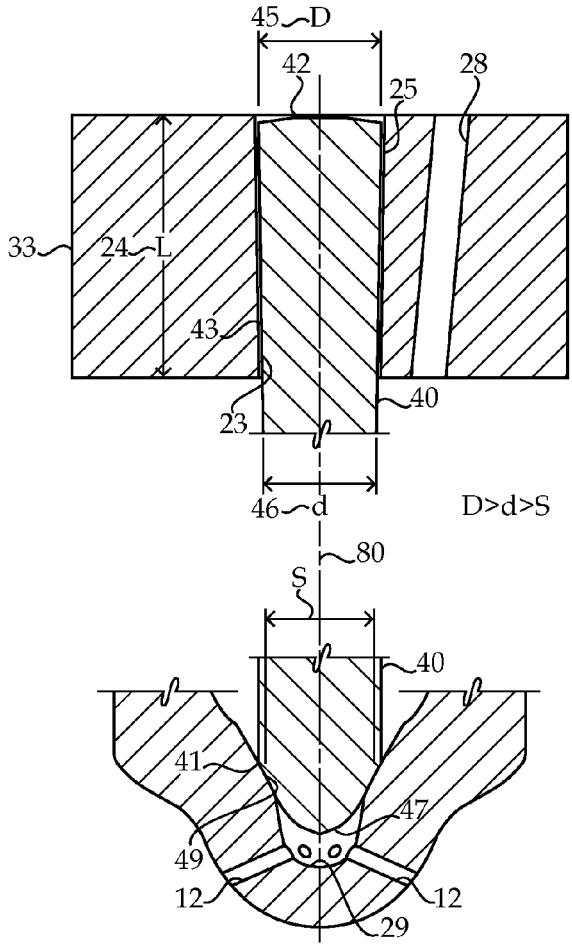
FIG. 2 is a partial enlarged broken sectioned view of the needle valve member and associated components from the fuel injector of FIG. 1.

Referring to FIGS. 1 and 2, a fuel injector 10 includes an injector body 11 that defines a nozzle outlet 12, a common rail inlet 13 and a drain outlet 18. Fuel injector 10 includes a direct operated check whose motion is controlled by an electronically controlled valve 15 that is housed in injector body 11. Although the present disclosure is illustrated in the context of an electronically controlled common rail fuel injector 10, those skilled in the art will appreciate that the disclosure is applicable across all fuel injector lines, from simple mechanically controlled pump and line nozzle assemblies through to the most complex electronically controlled fuel injectors for common rail systems, cam actuated systems and hybrids.

The injector body 11 includes a tip component 30, a spacer 31, a high pressure containment sleeve 32 and a guide component 33 that are held clamped together by a casing 34. Tip component 30 defines the nozzle outlets 12. Together, tip component 30, spacer 31, pressure containment sleeve 32 and guide component 33 define a nozzle chamber 21 that is fluidly connected to common rail inlet 13 by a nozzle supply passage 28. The common rail inlet 13 includes a conical seat 26 for receiving a conventional spherically ended quill (not shown) to facilitate fluid communication with a common rail (not shown).

A needle valve member 40 is positioned in injector body 11, and movable between a closed position as shown, and an upward open position. When in the closed position, an annular valve surface 49 contacts a seat 38 to block fluid communication between nozzle chamber 21 and sac 29. An opening hydraulic surface(s) 41 is positioned between annular valve surface 49 and a frustoconical segment 43. In the illustrated embodiment, the opening hydraulic surface 41 is partly located contiguous with annular valve surface 49 and partly located where the diameter grows to meet the small diameter end 46. An enlarged spring support 48 may be positioned between tip 47 and frustoconical segment 43. The annular valve surface 49 is positioned between the tip 47 and the enlarged spring shoulder 48. An enlarged guide portion 44 is positioned between the annular valve surface 49 and the enlarged spring support shoulder 48. As shown in FIG. 2, the nozzle outlets 12 extend from sac 29 to the outer surface of the fuel injector to facilitate spraying of fuel into the combustion space of an engine. When needle valve member 40 is in its upward open position, annular valve surface 49 moves out of contact with seat 38. Needle valve member 40 is normally biased downward toward its closed position by a spring 60 that is compressed between guide component 33 and annular spring support shoulder 48. A preload spacer 61 may be included in order to set the preload of spring 60 in a known manner. Needle valve member 41 includes an opening hydraulic surface(s) 41 exposed to fluid pressure in nozzle chamber 21, which is always fluidly connected to common rail inlet 13 during and between injection events. Needle valve member 40 may include an enlarged guide portion 44 that interacts with guide wall 35 of tip component 30 to ensure proper seating when moving toward a closed position as shown in FIG. 2.

Nozzle chamber 21 is separated from a needle control chamber 20 by a frustoconical bore 23 defined by guide component 33 as best shown in FIG. 2. A frustoconical segment 43 of needle valve member 40 is received in frustoconical bore 23. Although both the frustoconical bore 23 and the frustoconical segment 43 taper in a direction of tip 47 of needle valve member 40, there respective cone angles may differ. However, in the illustrated embodiment, the frustoconical shapes match so that a guide diametrical clearance 25 exists throughout the length 24 of bore 23. The diametrical clearance 25 between segment 43 and bore 23 is sufficiently small that the interaction with needle valve member 40 with the wall that defines bore 23 assists in guiding the movement of needle valve member 40, especially when moving downward toward its closed position, as shown.

Needle control chamber 20 is defined by guide segment 33, an orifice disk 36 (FIG. 1) and the closing hydraulic surface 22 of needle valve member 40. Thus, needle valve member 40 can be considered as including an opening hydraulic surface (s) 41 exposed to fluid pressure in nozzle chamber 21, and a closing hydraulic surface 42 exposed to fluid pressure in needle control chamber 20. The pressure in needle control chamber 20 is controlled by the actuation and de-actuation of electronically controlled valve 15. The electronically controlled valve 15 includes an electrical actuator 55, which may be solenoid or a piezo, operably coupled to a control valve member 56. When electrical actuator 55 is de-energized, such as between injection events, control valve member 56 is urged downward by a spring to close a low pressure passage fluid connection between needle control chamber 20 and drain outlet 18. It should be noted, however, that needle control chamber 20 is always fluidly connected to nozzle supply passage 28 via an orifice passage 70 defined by orifice disk 36. When electrical actuator 55 is energized, control valve member 56 is moved upward out of contact with a flat seat defined by a second orifice disk 37 to open the fluid communication with a low pressure passage connected to drain outlet 18. When this occurs, pressure in needle control chamber 20 drops, allowing the needle valve member 40 to move upward toward its open position to commence an injection event. Thus, electronically controlled valve 15 can be thought of as having a first configuration at which the needle control chamber 20 is fluidly blocked from a low pressure passage connected to drain outlet 18, and a second configuration at which the needle control chamber 20 is fluidly connected to the low pressure passage.

Those skilled in the art will appreciate that the action associated with the movement of needle valve member 40 is closely related to the effective area of closing hydraulic surface 42, the pressure in needle control chamber 20, the effective area of opening hydraulic surface(s) 41, the pressure in nozzle chamber 21 and the biasing force from spring 60. In almost all fuel injectors, the needle valve member is typically guided in its movement by a cylindrical guide segment received in a cylindrical bore, rather than the frustoconical segment received in a frustoconical bore as per the present disclosure. In all cases of the present disclosure, the frustoconical segment 43 of needle valve member 40 includes a large end diameter 45 that tapers inward in the direction of tip 47 down to a small end diameter 46. The effective opening hydraulic area is closely related to the difference between the small end diameter d and the seating diameter 51. In all cases of the present disclosure, the large end diameter 45 is greater than the small end diameter 46, which in turn is greater than the seating diameter 51.

Slight tapers fall within the scope of the present disclosure. However, one could expect the benefits associated with the present disclosure to become more problematic as the taper angle of the frustoconical shape increases due in part to the possibility of new failure modes in the movement of needle valve member 40 as well as the fact that the diametrical clearance 25 between the frustoconical segment 43 and the frustoconical shaped bore 23 increases when the needle valve member 40 moves toward its upward open position. This increase in the diametrical clearance becomes more exacerbated with larger taper angles. In general, predictable and repeatable performance is better achieved when the guide clearance 25 is small so that the fluid communication between nozzle chamber 21 and needle control chamber 20 via the diametrical clearance 25 is small in contributing to pressure changes within needle control chamber 20. When diametrical clearance 25 becomes larger, the potential for fluid flow in the diametrical clearance becomes greater, which can contribute to unpredictable and less control over pressure in needle control chamber 20. Given these considerations, the large end diameter 45 may be up to fifteen percent larger than the small end diameter 46, but that difference is preferably greater than five percent. Although not necessary, the length 24 of frustoconical bore 23 is greater than larger diameter 45. Those skilled in the art will appreciate that longer guide bores 23 tend to help in fluidly isolating needle control chamber from nozzle chamber along the diametrical clearance 25.

Over the years, engineers have observed, in general, lower undesirable emissions can be achieved from a combustion event when the needle valve member movement from its closed position toward its open position is slower than the counterpart movement from the open position toward the closed position. Also in general, the best results are often associated with very abrupt movement of the needle valve member from its open position to its closed position, but a slower opening rate associated with a more gradual increase in injection rate toward the beginning of an injection event is also desirable, again in general. The frustoconical shape of segment 43 of needle valve member 40 in conjunction with the frustoconical bore 43 may tend to improve both of these characteristics relative to a counterpart equivalent fuel injector that includes a typical cylindrical guide segment received in a cylindrical bore. This improvement may be attributable to the net opening hydraulic forces being smaller in the case of the frustoconical features of the present disclosure relative to the counterpart fuel injector with cylindrical features, and the net closing hydraulic force may be larger in the case of the present disclosure relative to a counterpart fuel injector with cylindrical features. The net result being a potentially slower opening of the needle valve member and a more abrupt closure, which may lead to an incremental improvement in reductions in undesirable emissions relative to an equivalent fuel injector with cylindrical features operating under the same pressures with an identical control signal. In addition, the frustoconical features of the present disclosure may afford the opportunity to decrease the minimum controllable fuel injection quantity for the fuel injector relative to its cylindrical feature counterpart.

Industrial Applicability

The present disclosure finds potential application in any fuel injector, but finds particular application in fuel injectors that include a direct operated check. Those skilled in the art will appreciate that a direct operated check refers to fuel injector with a needle valve member having an opening hydraulic surface exposed to fluid pressure in a nozzle chamber, and a closing hydraulic surface exposed to fluid pressure in a needle control chamber, whose pressure can be controlled by an electrical actuator in a known manner. The frustoconical strategy of the present disclosure allows for a potentially incremental improvement in performance of a fuel injector with a small change to the shape of a segment of the needle valve member and its associated guide bore. Thus, the present disclosure offers the possibility of a small incremental improvement in performance without the risks and uncertainties associated with a complete redesign.

When the fuel injector 10 operates, each injection event is initiated by moving needle valve member 40 from a closed position, as shown, toward an open position by reducing pressure on the closing hydraulic surface 42. Injection events are ended by moving the needle valve member from the open position toward the closed position by increasing pressure on the closing hydraulic surface 42. Between consecutive injection events, the pressure in nozzle chamber 21 and needle control chamber 20 may equalize to the pressure in nozzle supply passage 28 (common rail pressure) by the nozzle supply passage's 28 fluid connection to nozzle chamber 21 and to needle control chamber 20 via orifice passage 70. Thus, both the nozzle chamber and the needle control chamber are fluidly connected to the common rail inlet 13 between injection events. Movement of the needle valve member during both opening and closing is guided by an interaction between frustoconical segment 43 and frustoconical bore 23 as well as an interaction between large guide portion 44 with guide wall 35.

Figure 3:
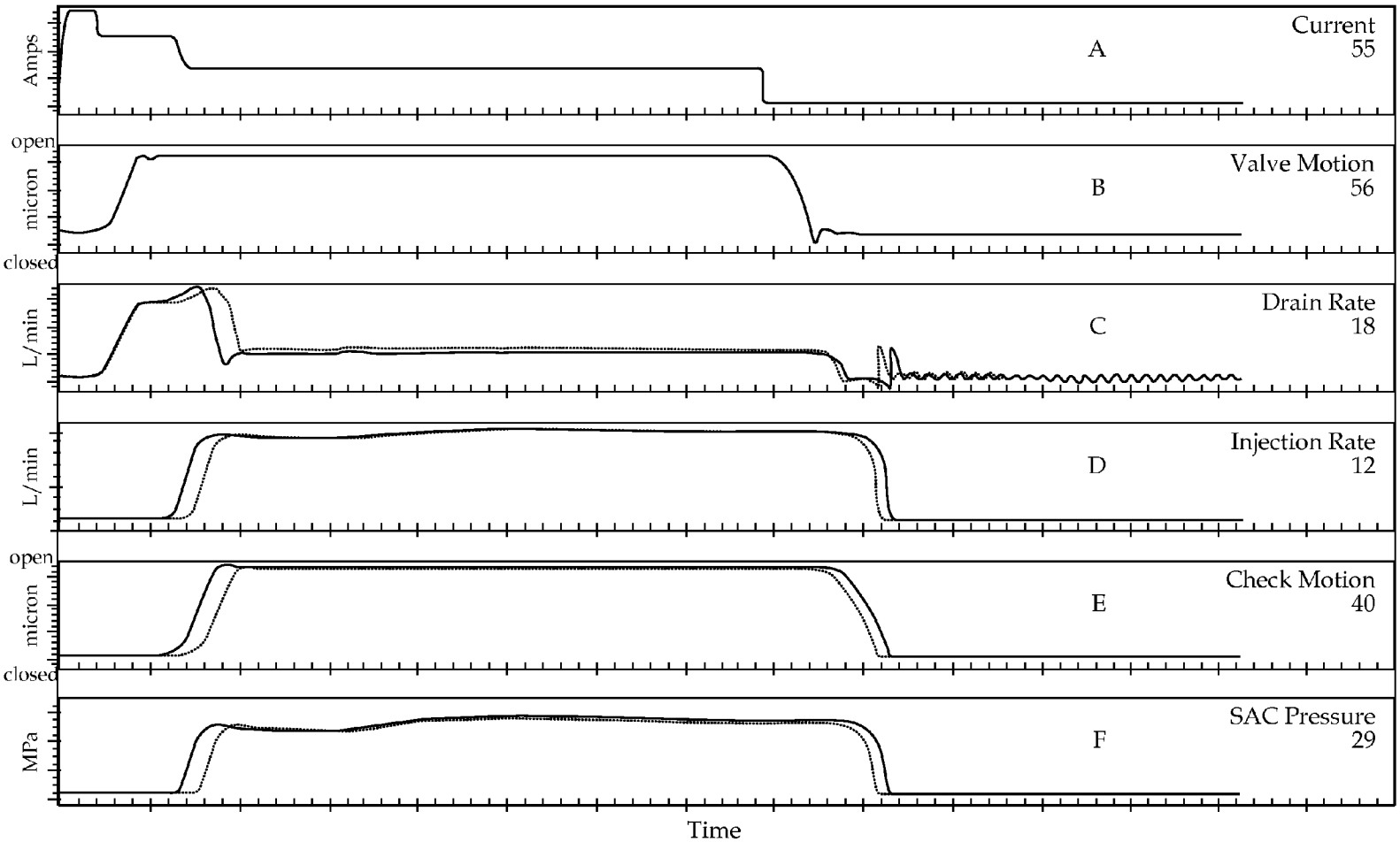
FIG. 3 is a series of graphs for an injection event including electrical actuator current (A), control valve motion (B), drain fluid rate (C), injection rate (D), needle valve member motion (E) and sac pressure (F) verses time for an injection event comparing the fuel injector of FIG. 1 to a counterpart fuel injector with cylindrical guide features.

Referring now in addition to the graphs of FIG. 3, an injection event according to the present disclosure is compared with an otherwise equivalent fuel injector that is identical except that it includes a cylindrical guide segment received in a cylindrical bore, whereas the present disclosure teaches a frustoconical segment 43 guided in a frustoconical bore 23. The graphs of FIG. 3 assume a narrowing tape on the needle valve member 40 from 3.8 millimeters down to 3.5 millimeters with a guide bore 23 length of about 9 millimeters. Thus, the narrowing tape of the frustoconical according to the present disclosure may or may not be detectable by the human eye and still yield measurable improvements in performance as per the graphs of FIG. 3. Graph (A) shows that the injection event is initiated by energizing electrical actuator 15 with a pull-in current. As the magnetic flux builds in electrical actuator 15, control valve member 56 begins to move off of its seated closed position toward its open position as shown in graph (B) of FIG. 3. The result being that a fluid flow rate from needle control chamber 20 to drain outlet 18 goes from zero to some higher amount as control valve member 56 moves toward its open position. When this occurs, pressure drops in needle control chamber 20. When the pressure gets sufficiently low, the net forces (hydraulic and spring) acting on needle valve member cause it to move from a closed position toward an open position as shown in the graph (C) of FIG. 3. The accompanying injection rate closely matches the movement of the needle valve member as shown in the graph (D). Of note in this case, even though the control signals are the same, the needle valve member for the counterpart fuel injector moves to an open position quicker and is followed more slowly by the needle valve member 40 for the fuel injector 10 of the present disclosure as shown in the graph (E). Graph (F) of FIG. 3 shows that the sac pressure, as expected, grows quickly after the needle valve member 40 moves from its closed position to its open position. After the control valve member 56 has moved to its open position, the current on electrical actuator 15 is dropped to a hold-in level as shown in the graph (A). During this time, the injection event commences as shown in the graph (D). When it comes time to end the injection event, the current to electrical actuator 55 is stopped as shown in the graph (A), and this is followed quickly by the movement by control valve member 56 from its open position to its closed position (graph B). It should be noted that current (control signal) and control valve member 56 movement for both injectors and the pressure trace in needle control chamber 20 are identical. However, the graph (E) shows that the needle valve member 40 for the fuel injector 10 according to the present disclosure moves toward a closed position quicker than its counterpart with cylindrical features as shown in graph (E). The result being an earlier and more abrupt end to the injection event as shown in the graph (D). Thus, if the frustoconical shape is properly chosen, the graphs of FIG. 3 suggest that if the fuel injection event were decreased in duration, one could expect the fuel injector according to the present disclosure to have a incremental improvement in the ability to produce reliable and controllable short injection events that may be shorter than that possible with a counterpart fuel injector having cylindrical features. Thus, the present disclosure provides for a slight change that could be made to virtually any fuel injector to improve performance at the beginning and end of an injection event, and maybe most importantly provide the fuel injector with an incremental improvement in its minimal controllable injection quantity, which is often a key performance parameter in any injector specification. For example, a minimum controllable injection quantity means an amount of fuel that is injected with a certain control signal with an acceptable variance. An acceptable variance on the minimum quantity might be 10%.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel injector comprising:

an injector body with a tip component that defines at least one nozzle outlet, and having disposed therein a needle control chamber separated from a nozzle chamber by a frustoconical bore that tapers inward in a direction of the tip component;

a needle valve member positioned in the injector body and including an opening hydraulic surface exposed to fluid pressure in the nozzle chamber and a closing hydraulic surface exposed to fluid pressure in the needle control chamber, and being movable between a first position at which the nozzle outlet is blocked from the nozzle chamber, and a second position at which the nozzle outlet is open to the nozzle chamber;

a frustoconical segment of the needle valve member being positioned in the frustoconical bore and having a narrowing taper in a direction of the tip component; and the frustoconical bore has a length greater than a large end diameter.

2. The fuel injector of claim 1 including an electronically controlled valve having a first configuration at which the needle control chamber is fluidly blocked from a low pressure passage, and a second configuration at which the needle control chamber is fluidly connected to the low pressure passage.

3. The fuel injector of claim 2 wherein the injector body includes common rail inlet with a conical seat and being fluidly connected to the nozzle chamber.

4. The fuel injector of claim 3 wherein the needle valve member includes an enlarged guide portion located in the tip component in guiding interaction with a guide wall that defines a portion of the nozzle chamber.

5. The fuel injector of claim 4 wherein the frustoconical bore matches the frustoconical segment of the needle valve member.

6. The fuel injector of claim 2 wherein the large end diameter is between five and fifteen percent larger than a small end diameter.

7. The fuel injector of claim 1 wherein the frustoconical segment of the needle valve member has a diametrical clearance with respect to the injector body over an entire length of the frustoconical bore.

8. The fuel injector of claim 7 wherein the large end diameter that is between five and fifteen percent larger than a small end diameter.

9. The fuel injector of claim 1 including an electronically controlled valve having a first configuration at which the needle control chamber is fluidly blocked from a low pressure passage, and a second configuration at which the needle control chamber is fluidly connected to the low pressure passage;

the injector body includes a common rail inlet with a conical seat and being fluidly connected to the nozzle chamber;

the needle valve member includes an enlarged guide portion located in the tip component in guiding interaction with a guide wall that defines a portion of the nozzle chamber; and the frustoconical bore matches the frustoconical segment of the needle valve member.

10. A method of operating a fuel injector that includes an injector body with a tip component that defines at least one nozzle outlet, and having disposed therein a needle control chamber separated from a nozzle chamber by a frustoconical bore that tapers inward in a direction of the tip; a needle valve member positioned in the injector body and including an opening hydraulic surface exposed to fluid pressure in the nozzle chamber and a closing hydraulic surface exposed to fluid pressure in the needle control chamber, and being movable between a first position at which the nozzle outlet is blocked from the nozzle chamber, and a second position at which the nozzle outlet is open to the nozzle chamber; a frustoconical segment of the needle valve member being positioned in the frustoconical bore and having a narrowing taper in a direction of the tip component; and the frustoconical bore has a length greater than a large end diameter, the method comprising the steps of:

moving the needle valve member from a closed position toward an open position to initiate an injection event by reducing pressure on the closing hydraulic surface; and moving the needle valve member from the open position toward the closed position to end an injection event by increasing pressure on the closing hydraulic surface.

11. The method of claim 10 including a step of equalizing pressures in the nozzle chamber and the needle control chamber between two consecutive injection events.

12. The method of claim 11 including a step of fluidly connecting the nozzle chamber to a common rail inlet during and between injection events.

13. The method of claim 12 wherein the step of reducing pressure on the closing hydraulic surface includes fluidly connecting the needle control chamber to a low pressure passage; and the step of increasing pressure on the closing hydraulic surface including fluidly blocking the needle control chamber from the low pressure passage.

14. The method of claim 13 including a step of guiding movement of the needle valve member on a guide wall in the tip component.

15. A needle valve member for a fuel injector comprising:

a frustoconical segment positioned between a closing hydraulic surface and a tip;

the frustoconical segment narrowing in a direction of the tip;

an enlarged spring support shoulder positioned between the tip and the frustoconical segment;

an annular valve surface positioned between the tip and the enlarged spring support shoulder;

an opening hydraulic surface positioned between the annular valve surface and the frustoconical segment; and the frustoconical segment has a length greater than a large end diameter.

16. The needle valve member of claim 15 including a guide portion positioned between the annular valve surface and the enlarged spring support shoulder.

17. The needle valve member of claim 15 wherein the large end diameter is between five and fifteen percent larger than a small end diameter.

* * * * *